US005518048A

United States Patent [19]

Derby

[11] Patent Number: 5,518,048

[45] **Date of Patent: *May 21, 1996**

[54] FULL SACK COMPRESSOR

[75] Inventor: Norwin C. Derby, Sherman, Tex.

[73] Assignee: B.A.G. Corporation, Dallas, Tex.

[ * ] Notice: The term of this patent shall not extend beyond the expiration date of Pat. No. 5,279,339.

[21] Appl. No.: 409,926

[22] Filed: Mar. 23, 1995

Related U.S. Application Data

[63] Continuation of Ser. No. 135,546, Oct. 14, 1993, abandoned, which is a continuation of Ser. No. 921,957, Jul. 31, 1992, Pat. No. 5,279,339, which is a continuation of Ser. No. 634,021, Dec. 26, 1990, abandoned, which is a continuation-in-part of Ser. No. 558,678, Jul. 27, 1990, abandoned, which is a continuation-in-part of Ser. No. 407,901, Sep. 15, 1989, abandoned.

[51] Int. Cl.[6] ..... B65B 1/26

[52] U.S. Cl. ..... 141/80; 141/67; 141/59; 141/65; 141/10; 141/313

[58] Field of Search ..... 141/5, 7, 8, 10–12, 141/43, 48, 50, 51, 57, 59, 65, 67–71, 73, 80, 83, 114, 313–317

[56] References Cited

U.S. PATENT DOCUMENTS

| | | | |
|---|---|---|---|
| 2,138,356 | 11/1938 | Ryan et al. . | |
| 2,142,990 | 1/1939 | Belcher . | |
| 2,780,247 | 2/1957 | Claassen, Jr. . | |
| 2,783,786 | 3/1957 | Carter . | |
| 2,964,070 | 12/1960 | Linhardt . | |
| 3,542,091 | 11/1970 | Carter . | |
| 3,586,066 | 6/1971 | Brown . | |
| 3,605,826 | 9/1971 | Carter . | |
| 3,785,410 | 1/1974 | Carter . | |
| 3,788,368 | 1/1974 | Geng et al. | 141/67 |
| 4,182,386 | 1/1980 | Alack . | |
| 4,185,669 | 1/1980 | Jevakohoff . | |
| 4,219,054 | 8/1980 | Carter et al. | 141/10 |
| 4,457,125 | 7/1984 | Fishburne . | |
| 4,526,214 | 7/1985 | McGregor . | |
| 4,614,213 | 9/1986 | Englin . | |
| 4,648,432 | 3/1987 | Mechalas | 141/68 |
| 4,825,913 | 5/1989 | Stott . | |
| 4,854,353 | 8/1989 | Russell . | |
| 4,872,493 | 10/1989 | Everman . | |

FOREIGN PATENT DOCUMENTS

| | | |
|---|---|---|
| 0443349 | 8/1991 | European Pat. Off. . |
| 1265286 | 5/1961 | France . |
| 1124501 | 5/1989 | Japan . |
| 3176305 | 7/1991 | Japan . |
| 1323467 | 7/1987 | U.S.S.R. . |

*Primary Examiner*—J. Casimer Jacyna
*Attorney, Agent, or Firm*—Michael A. O'Neil

[57] ABSTRACT

A full sack compressor for deaerating flowable material includes a hollow, rectangular chamber connected to a vacuum pump for establishing a vacuum when filled with flowable material, causing the flowable material to deaerate and subsequently compact when atmospheric pressure is restored.

12 Claims, 2 Drawing Sheets

FULL SACK COMPRESSOR

This application is a file wrapper continuation of 08/135,546, filed Oct. 14, 1993, now abandoned, which is a continuation of Ser. No. 07/921,957, filed Jul. 31, 1992, now issued as U.S. Pat. No. 5,279,339, which is a continuation of Ser. No. 07/634,021, filed Dec. 26, 1990, now abandoned, which is a continuation-in-part of Ser. No. 07/558,678, filed Jul. 27, 1990 now abandoned, which is a continuation-in-part of Ser. No. 07/407,901 filed Sep. 15, 1989, now abandoned.

TECHNICAL FIELD OF THE INVENTION

This invention relates to an apparatus for deaerating and compacting flowable material, and in particular to a full sack compressor for deaerating and compacting flowable material in flexible bulk containers.

BACKGROUND OF THE INVENTION

Containers used in the storage, transportation and dispensation of flowable material have been around for as long as civilization itself. The use of such containers, however, has always been limited by (1) the weight, density and other physical properties of the material being stored and (2) by the process and type of container used to store the material.

Traditional filling processes and containers have long been encumbered by a simple phenomenon that has exasperated consumers for decades—settling. Settling, as any purchaser of a bag of potato chips knows, means the bag is never completely filled when opened. This occurs due to the settling of the product inside during its filling and shipment. This simple settling phenomenon causes tremendous economic waste each year because of the misuse of storage space and container material. This has been particularly true in the storage, transportation and dispensation of flowable material in semi-bulk quantities such as grains, chemicals and other bulky substances stored in flexible bulk containers, such as those disclosed in U.S. Pat. Nos. 4,143,796 and 4,194,652.

It has long been known that the settling process is caused by the natural aeration of flowable material as the material is placed inside a container. As the container is shipped to its final destination, the air escapes from the aerated material causing the product to compact and reduce in volume. Thus, when the container is opened, the flowable material has settled to the bottom of the container, i.e. the bag of potato chips is only half full.

Any process or system, such as the present invention, for storing material in a container for shipment that allows all of the container to be filled with product and eliminates the excess air results in an enormous cost savings. Indeed, the shipment of smaller sized containers using vacuum-sealed packages such as, e.g., vacuum-sealed coffee containers, has alleviated many of the above problems of cost and time.

Although vacuum-sealed packaging has proved to be an efficient, cost-saving and consumer-pleasing method of shipping small quantities of goods, before now, it has been impossible to apply such techniques to other areas of storage, transportation and dispensation of flowable material. This has been particularly true in the market for semi-bulk flowable material.

SUMMARY OF THE INVENTION

The present invention relates to the deaerating and compacting of flowable material, and in particular to a full sack compressor for use with flexible bulk containers used to store, transport and dispense flowable material in semi-bulk quantities.

The full sack compressor of the present invention generally comprises a rectangular chamber in which a flexible container is positioned; means for controlling the movement of flowable material into the flexible container; means for determining the amount of flowable material in the flexible container; means for establishing a vacuum in the rectangular chamber for deaerating the flowable material; and means for compacting the deaerated flowable material by substantially instantaneously returning the interior of the chamber to atmospheric pressure.

In the preferred embodiment of the invention, a conventional slide or knife gate valve is located at one end of the rectangular chamber. This gate valve controls the movement of flowable material into the flexible container positioned inside of the rectangular chamber. A conventional vacuum pump capable of pulling a vacuum of eighteen (18) inches of mercury for deaerating the flowable material is connected to the rectangular chamber through a series of valves and vacuum lines.

Operation of the full sack compressor is simple and easy. The flowable material is placed inside of the flexible container positioned within the rectangular chamber. A vacuum is established in the rectangular chamber through the use of the vacuum pump. After sufficient deaeration of the flowable material is achieved, the vacuum is released and the interior of the rectangular chamber is returned to atmospheric pressure substantially instantaneously, causing the deaerated material to compact. The compacted, deaerated flowable material then drops to the bottom of the flexible container.

By deaerating and compacting the flowable material in the flexible container, the flowable material is presettled and will not settle during shipment. Thus, the present invention allows for complete utilization of the flexible container, eliminating wasted space and allowing for the shipment of more material without any increase in the container volume. Therefore, the use of the present invention affords numerous advantages over the prior art.

BRIEF DESCRIPTION OF THE DRAWINGS

A more complete understanding of the invention may be had by reference to the following Detailed Description when taken in conjunction with the accompanying Drawings, in which.

DETAILED DESCRIPTION OF THE INVENTION

Figure 1:
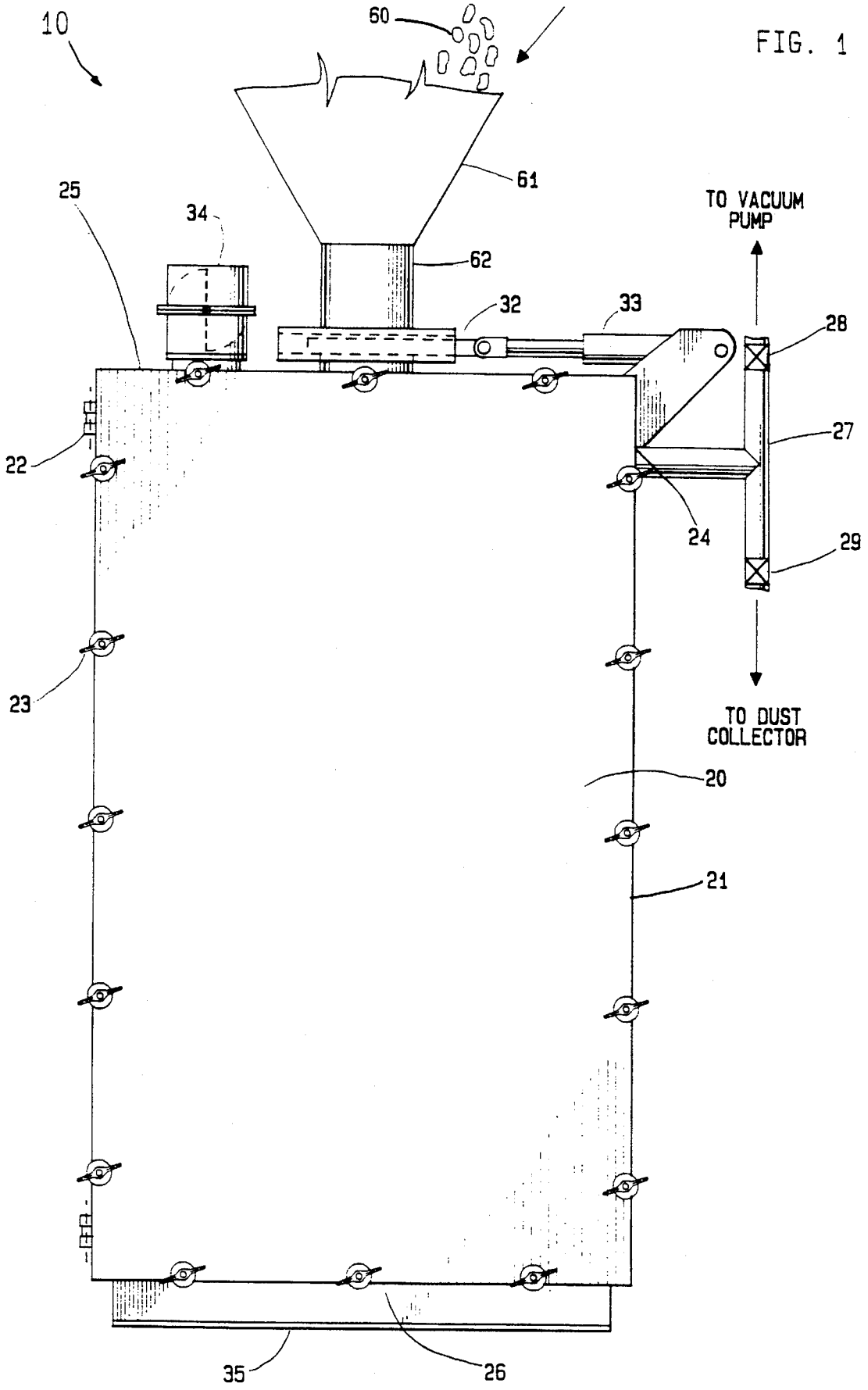
FIG. 1 is a frontal view of a closed full sack compressor incorporating the present invention.

Referring to FIG. 1, there is shown a full sack compressor 10 incorporating a first embodiment of the present invention. The full sack compressor 10 has a hollow, rectangular chamber 20 which holds a flexible container 70 of the type used for shipment and storage of flowable material 60. The chamber 20 has first end 25 and second end 26.

The chamber 20 has at least one airtight door 21 which is ribbed on the outside for reinforcement. Hinges 22 attach the door 21 to the chamber 20. A series of fasteners 23 are attached to the door 21 and to the chamber 20. When tightened, the fasteners 23 assist in creating a vacuum within the chamber 20. The chamber 20 sits on a support member 35 which maintains the chamber 20 in a level position. The second end 26 of the chamber 20 is in contact with the upper surface of the support member 35.

Attached to the first end 25 of the chamber 20 is a conventional knife or slide gate valve 32 and an associated air cylinder 33 which controls the opening and closing of the gate valve 32. The gate valve 32 and air cylinder 33 are of conventional types well known in the art. Attached to the gate valve 32 is an intake chute 62 through which flowable material 60 moves from the holding/storage device 61 into the chamber 20. When the gate valve 32 is in the open position, flowable material 60 moves through the gate valve 32 into the flexible container 70 positioned inside of the hollow, rectangular chamber 20.

A butterfly valve 34 is attached to the first end 25 of the chamber 20. When the valve 34 is open, air enters the chamber 20.

The chamber 20 has an opening 24 into which a vacuum line 27 runs. In the preferred embodiment of the invention, there is at least one opening 24 and two vacuum lines 27. One of the vacuum lines 27 is connected to a valve 29 which in turn connects to a conventional dust collector (not shown). The second vacuum line 27 extends from the first vacuum line 27 and connects to another valve 28 and to a conventional vacuum pump (not shown).

Although any conventional vacuum pump may be utilized with the present invention, the vacuum pump must be capable of pulling a minimum of eighteen (18) inches of mercury during operation. Throughout the remainder of the specification, the term vacuum is used for clarity, it being understood that the term means a partial vacuum of at least eighteen (18) inches of mercury, a total or perfect vacuum being impossible to achieve.

Figure 2:
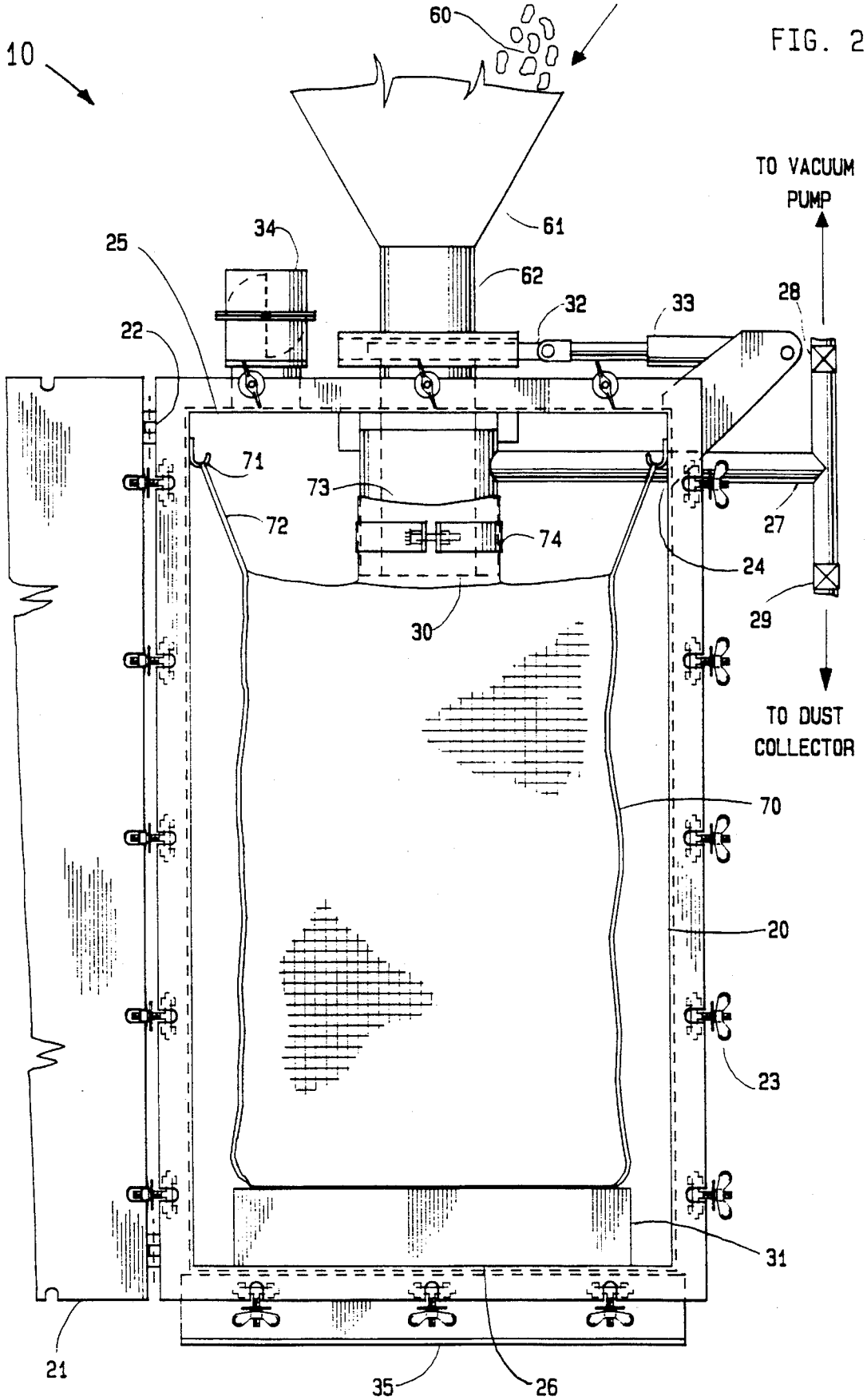
FIG. 2 is a frontal view of an open full sack compressor incorporating the present invention and illustrating its use with flexible bulk containers.

In FIG. 2 there is shown an open full sack compressor 10 incorporating the present invention and illustrating its use with flexible bulk containers 70. FIG. 2 illustrates the initial start-up position of the full sack compressor 10.

Although the full sack compressor 10 illustrated in FIG. 2 is used in connection with the filling of a flexible container 70 for handling flowable material 60, it must be understood that the present invention is capable of being utilized with any type of container, no matter how large or small, where it is desired to compact, deaerate and densify flowable material 60 for packing into a container for shipment and storage.

In FIG. 2, valves 28, 29, 32 and 34 are closed. The flowable material 60 is contained within a conventional holding/storage device 61, such as a hopper. During operation of the full sack compressor 10, a flexible container 70 is connected to the full sack compressor 10 through conventional means such as hooks 71 mounted on the inner surface of the chamber 20. Support loops 72 on the container 70 are placed over the hooks 71 to suspend the container 70 below the discharge chute 30. A filling tube 73 on the container 70 is placed around the discharge chute 30 and secured with a clamp band 74 to prevent spillage while filling the container 70.

Positioned on the floor of the chamber 20 is a scale 31 upon which the flexible container 70 rests. The scale 31 is used for determining the amount of flowable material 60 in the flexible container 70.

After the door 21 is closed, the air cylinder 33 opens the slide gate valve 32. Flowable material 60 contained within the holding/storage device 61 moves through the intake chute 62 and the slide gate valve 32 into the flexible container 70 positioned within the hollow, rectangular chamber 20.

While flowable material 60 moves into the flexible container 70, the valve 29 to the dust collector is opened, venting dust from the chamber 20 through the vacuum line 27 to the dust collector. Valves 28 and 34 remain closed.

The movement of flowable material 60 into the flexible container 70 is controlled either by weight or height level. When a predetermined level or weight is reached in the flexible container 70, the amount registers on the scale 31 mounted on the floor of the chamber 20 on which the flexible container 70 rests. The gate valve 32 automatically closes, preventing the movement of additional flowable material 60 into the flexible container 70. The valve 29 to the dust collector also closes.

At this point, the valve 28 connected to the vacuum pump is opened. Air is evacuated from the rectangular chamber 20 through the use of the vacuum line 27 connected to the vacuum pump, establishing a vacuum in the chamber 20.

When air is initially evacuated from the rectangular chamber 20, the volume of flowable material 60 actually increases slightly as the internal air passes through it and the vacuum is established. Thus, there is actually a volume gain until the chamber 20 is returned to atmospheric pressure.

Once the vacuum reaches the level necessary to achieve the desired deaeration of the flowable material 60, the valve 28 to the vacuum pump is closed and the butterfly valve 34 is opened immediately. Air at atmospheric pressure substantially instantaneously enters the rectangular chamber 20. The return of the chamber 20 to atmospheric pressure compresses and compacts the deaerated, flowable material 60, both axially and radially. The volume of flowable material 60 is now significantly less than when first introduced into the flexible container 70.

The compacted, deaerated flowable material 60 forms a compact "slug" of material in the bottom of the flexible container 70. The foregoing sequence is then repeated one or more times until the container 70 is filled with compacted material 60.

Although not shown, it should be understood that the operation of the preferred embodiment of the full sack compressor 10 may be performed either manually or automatically through the use of conventional electronic circuitry.

Although a preferred embodiment of the present invention has been illustrated in the accompanying Drawings and described in the foregoing Detailed Description, it will be appreciated by those skilled in the art that various modifications and rearrangements of the component parts and elements of the present invention are possible within the scope of the present invention.

I claim:

1. A full sack compressor for deaerating and compacting flowable material within a flexible container, comprising:

a sealable chamber, having a top end and bottom end and consisting solely of air impervious side walls extending from the top end to the bottom end, the sealable chamber further including means for receiving the flexible container;

first valve means;

means for opening the first valve means for dispensing flowable material into the flexible container positioned within the chamber and for closing the valve means for sealing the chamber;

second valve means;

means for opening the second valve means for establishing a vacuum within the sealed chamber to deaerate the flowable material dispensed within the flexible container and for closing the second valve means for sealing the chamber;

third valve means;

means for opening the third valve means for admitting air and substantially instantaneously returning the interior of the chamber to atmospheric pressure into the chamber and for closing the third valve means for sealing the chamber;

a flowable material fill chute having an inlet end connected to the first valve means and having an outlet end extending into the chamber for insertion into, and connection to, a filling tube of the flexible container;and means for collecting dust while the first valve means is open and flowable material are being dispensed; and a dust line connecting the means for collecting dust to the flowable material fill chute within the chamber for drawing dust from the flexible container through the fill chute during dispensing of flowable materials.

2. An Apparatus for filling a flexible container with deaerated and compacted flowable materials, comprising:

a sealable chamber, having a top end and bottom end and consisting solely of air impervious side walls extending from the top end to the bottom end, the sealable chamber further including means for receiving the flexible container therein;

a fill chute connected to the sealable chamber, said fill chute having an outlet end inserted into the flexible container for dispensing flowable material within the flexible container;

first valve means coupled at an inlet end of the fill chute;

means for opening the first valve means thereby allowing passage of a predetermined amount of flowable materials into the chamber for deposit within the flexible container and for closing the first valve means, thereby sealing the chamber both prior to and following the dispensing of the predetermined amount;

a vacuum source;

second valve means coupled between the vacuum source and the chamber;

means for opening the second valve means thereby applying a vacuum to interior of the chamber for deaerating the dispensed amount of flowable material within the flexible container, and for closing the second valve means, thereby sealing the chamber both prior to and following deaeration;

third valve means coupled between the chamber and a source of atmospheric pressure;

means for closing the third valve means for sealing the chamber when the second valve means is in the open position and for opening the third valve means for admitting air to the chamber thereby substantially instantaneously returning the interior of the chamber to atmospheric pressure, the return of air at atmospheric pressure to the interior of the chamber compacting the deaerated flowable materials within the flexible container;

means for collecting dust; and fourth valve means coupled between the means for collecting dust and the fill chute having an open position for drawing dust through the fill chute during the dispensing of the predetermined amount of flowable material.

3. The apparatus as in claim 2 wherein the vacuum source pulls a vacuum of more than eighteen inches of mercury and causes a slight increase in the volume occupied by the flowable materials within the flexible container when the second valve means is initially moved to the open position.

4. An apparatus for filling a flexible container with deaerated and compacted flowable materials comprising:

a sealable chamber, having a top end and bottom end and consisting solely of air impervious side walls extending from the top end to the bottom end, the sealable chamber further including means for receiving the flexible container therein;

a fill chute connected to the sealable chamber, said fill chute having an outlet end inserted into the flexible container for dispensing flowable material within the flexible container;

first valve means coupled at an inlet end of the fill chute;

means for opening the first valve means thereby allowing passage of a predetermined amount of flowable materials into the chamber for deposit within the flexible container and for closing the first valve means, thereby sealing the chamber both prior to and following the dispensing of the predetermined amount;

a vacuum source that pulls a vacuum of more than eighteen inches of mercury and causes a slight increase in the volume occupied by the flowable materials within the flexible container;

second valve means connected to the vacuum source;

a vacuum line connected between the second valve means and the fill chute so that the vacuum within the chamber is drawn solely through the fill chute;

means for opening the second valve means after the first valve means is closed thereby applying a vacuum to the fill chute and deaerating the dispensed amount of flowable material within the flexible container, and for closing the second valve means, thereby sealing the chamber both prior to and following deaeration; and third valve means coupled between the chamber and a source of atmospheric pressure;

means for closing the third valve means for sealing the chamber when the second valve means is in the open position and for opening the third valve means for admitting air to the chamber thereby substantially instantaneously returning the interior of the chamber to atmospheric pressure, the return of air at atmospheric pressure to the interior of the chamber compacting the deaerated flowable materials within the flexible container.

5. The apparatus as in claim 4 wherein the outlet for the fill chute further includes means for sealing the flexible container thereto to prevent dispensed flowable materials from escaping from the interior of the flexible container during dispensing, deaeration and compacting.

6. The apparatus as in claim 4 wherein the deaerated flowable materials which are compacted by the return of air at atmospheric pressure within the chamber are compacted in both an axial and a radial direction to form a flowable material slug within the flexible container.

7. A method for filling a flexible container having a top opening with deaerated and compacted flowable material, comprising the steps of:

(a) dispensing a predetermined amount of flowable material into the flexible container;

(b) sealing the flexible container within an air impervious chamber;

(c) subsequent to steps (a) and (b), drawing a vacuum within the sealed chamber solely through the top opening of the flexible container to deaerate the flowable material; and (d) subsequent to step (c), admitting air to the chamber thereby returning the interior of the chamber to atmospheric pressure in a substantially instantaneous fashion, the returning air compacting the deaerated flowable material within the flexible container into a flowable material slug.

8. The method as in claim 7 wherein the step of dispensing further includes the step of venting dust from the chamber while the predetermined amount of flowable material is dispensed into the flexible container.

9. The method as in claim 7 wherein the step of dispensing further comprises the step of filling the flexible container through a fill chute mounted to the chamber and having an outlet secured to the flexible container.

10. The method as in claim 9 wherein the step of drawing a vacuum further includes the step of drawing the vacuum through the fill chute.

11. The method as in claim 7 wherein the step of drawing the vacuum further includes the step of causing the volume occupied by the predetermined amount of flowable materials dispensed with the flexible container to slightly expand as the vacuum is initially drawn.

12. The method as in claim 7 further including the step of repeating the steps of claim 7 until the flowable material slugs fill the flexible container to a predetermined limit.

* * * * *